US010132537B1

(12) United States Patent
Stamp et al.

(10) Patent No.: US 10,132,537 B1
(45) Date of Patent: Nov. 20, 2018

(54) HEAT EXCHANGER

(71) Applicant: Daikin Applied Americas Inc., Minneapolis, MN (US)

(72) Inventors: Jeffrey Stamp, Minneapolis, MN (US); Louis A. Moreaux, Minneapolis, MN (US); Michael Wilson, Plymouth, MN (US)

(73) Assignee: DAIKIN APPLIED AMERICAS INC., Minneapolis, MN (US)

( * ) Notice: Subject to any disclaimer, the term of this patent is extended or adjusted under 35 U.S.C. 154(b) by 0 days.

(21) Appl. No.: 15/600,922

(22) Filed: May 22, 2017

(51) Int. Cl.
*F25B 39/00* (2006.01)
*F25B 39/02* (2006.01)

(52) U.S. Cl.
CPC ..... *F25B 39/00* (2013.01); *F25B 39/028* (2013.01); *F25B 2339/0242* (2013.01); *F25B 2400/23* (2013.01); *F25B 2500/28* (2013.01)

(58) Field of Classification Search
CPC ..... F25B 39/00; F25B 39/028; F25B 2339/0242; F25B 2400/23
USPC ..... 165/158
See application file for complete search history.

(56) References Cited

U.S. PATENT DOCUMENTS 6,167,713 B1 1/2001 Hartfield et al.
6,253,571 B1 * 7/2001 Fujii ..... F25B 15/008 62/484
6,868,695 B1 * 3/2005 Dingel ..... F25B 39/028 165/115
8,863,551 B2 * 10/2014 de Larminat ..... F25B 39/028 62/525
9,810,458 B2 * 11/2017 Hattori ..... F25B 39/00
2008/0148767 A1 * 6/2008 De Larminat ..... F25B 39/028 62/498

(Continued)

FOREIGN PATENT DOCUMENTS

JP WO 2016002784 A1 * 1/2016 ..... F25B 39/02

OTHER PUBLICATIONS

International Search Report for the corresponding international application No. PCT/US2018/030813, dated Aug. 2, 2018.

(Continued)

*Primary Examiner* — Raheena R Malik
(74) *Attorney, Agent, or Firm* — Global IP Counselors, LLP

(57) ABSTRACT

A heat exchanger includes a shell, a refrigerant distributor disposed in the shell, and a heat transferring unit disposed in the shell. The shell has a refrigerant inlet through which at least liquid refrigerant flows and a shell refrigerant vapor outlet. The refrigerant distributor includes a first portion and a second portion. The first portion is connected to the refrigerant inlet to receive refrigerant from the inlet. The first portion has at least one first refrigerant liquid distribution opening and a first refrigerant vapor distribution outlet opening. The second portion is connected to the first portion to receive refrigerant from the first refrigerant liquid distribution opening. The second portion has at least one second refrigerant liquid distribution opening and at least one second refrigerant vapor distribution outlet opening. The heat transferring unit is disposed below the refrigerant distributor to receive liquid refrigerant discharged from the second portion of refrigerant distributor.

21 Claims, 8 Drawing Sheets

(56) References Cited

U.S. PATENT DOCUMENTS

| | | | | |
|---|---|---|---|---|
| 2009/0178790 | A1* | 7/2009 | Schreiber | F25B 39/028 165/158 |
| 2010/0276130 | A1* | 11/2010 | de Larminat | F25B 39/028 165/157 |
| 2010/0326108 | A1* | 12/2010 | Schreiber | F25B 39/028 62/218 |
| 2011/0017432 | A1* | 1/2011 | Kulankara | F28D 3/02 165/115 |
| 2011/0226005 | A1 | 9/2011 | Lee | |
| 2013/0277018 | A1 | 10/2013 | Numata et al. | |
| 2014/0284032 | A1 | 9/2014 | Gentry et al. | |
| 2015/0013950 | A1* | 1/2015 | Numata | F25B 39/02 165/157 |
| 2015/0013951 | A1 | 1/2015 | Numata et al. | |
| 2016/0320136 | A1 | 11/2016 | Christians et al. | |
| 2016/0341457 | A1 | 11/2016 | Christians | |
| 2017/0138652 | A1* | 5/2017 | Hattori | F25B 39/00 |
| 2017/0153061 | A1* | 6/2017 | Yoshioka | F25B 39/02 |
| 2017/0254573 | A1* | 9/2017 | Numata | F28D 3/04 |

OTHER PUBLICATIONS

Written Opinion for the corresponding international application No. PCT/US2018/030813, dated Aug. 2, 2018.

* cited by examiner

HEAT EXCHANGER

BACKGROUND OF THE INVENTION

Field of the Invention

This invention generally relates to a heat exchanger adapted to be used in a vapor compression system. More specifically, this invention relates to a heat exchanger including a refrigerant distributor.

Background Information

Vapor compression refrigeration has been the most commonly used method for air-conditioning of large buildings or the like. Conventional vapor compression refrigeration systems are typically provided with an evaporator, which is a heat exchanger that allows the refrigerant to evaporate from liquid to vapor while absorbing heat from liquid to be cooled passing through the evaporator. One type of evaporator includes a tube bundle having a plurality of horizontally extending heat transfer tubes through which the liquid to be cooled is circulated, and the tube bundle is housed inside a cylindrical shell. There are several known methods for evaporating the refrigerant in this type of evaporator. For example, there are flooded evaporators, falling film evaporators, and hybrid falling film evaporators.

Regardless of the type of evaporator, e.g., flooded, falling film, or hybrid, a distributor is provided to distribute refrigerant entering the evaporator to the tube bundle. U.S. patent publication No. 2013/0277018 discloses one example of such a distributor.

SUMMARY OF THE INVENTION

In at least a falling film evaporator it has been discovered that it is desirable for as much as possible of the liquid refrigerant be separated from the gas refrigerant in the distributor so that only liquid refrigerant is distributed to the tube bundle and only gas refrigerant exits the shell.

Therefore, one object of the present invention is to provide an evaporator with a distributor that sufficiently separates liquid and gas refrigerant.

It has been further discovered that if gas liquid separation in the distributor is not sufficient, liquid droplets of refrigerant can be contained in the gas refrigerant. Such liquid droplets will not be distributed to the tube bundle and will exit the evaporator with exit vapor flow and be returned to the compressor. This phenomenon is called liquid carryover, which may reduce performance of the evaporator and/or compressor, and thus, the entire refrigerant cycle.

It has been further discovered that if gas liquid separation in the distributor is not sufficient, gas bubbles can be contained in the liquid refrigerant. Such gas bubbles can effectively reduce the liquid amount supplied to the tube bundle, which may reduce heat transfer performance of the evaporator.

Therefore, another object of the present invention is to provide an evaporator with a distributor that distributes liquid refrigerant to the tube bundle with reduced gas bubbles and reduces liquid droplet content (liquid carryover) in refrigerant exit vapor, and thus, improves performance of the evaporator and/or compressor.

It has been further discovered that if vapor speed is relatively high, vapor will entrain liquid. In addition, high vapor speeds can cause excess shear on the liquid surface, impacting the thickness (level) of liquid in the distributor. This varying liquid level thickness in the distributor can lead to uneven dripping of liquid (e.g., non-uniform distribution).

Therefore, another object of the present invention is to provide an evaporator with a distributor that evenly distributes liquid refrigerant.

It has also been discovered that insufficient gas liquid separation can be more prevalent in a case where a Low Pressure Refrigerant (LPR) refrigerant is used because a low pressure refrigerant has a lower density.

Therefore, yet another object of the present invention is to provide an evaporator with a distributor with improved liquid vapor separation even when LPR refrigerant is used.

A heat exchanger according to a first aspect of the present invention is adapted to be used in a vapor compression system. The heat exchanger includes a shell, a refrigerant distributor, and a heat transferring unit. The shell has a refrigerant inlet through which at least refrigerant with liquid refrigerant flows and a shell refrigerant vapor outlet. A longitudinal center axis of the shell extends generally parallel to a horizontal plane. The refrigerant distributor extends longitudinally within the shell and is connected to the refrigerant inlet. The refrigerant distributor includes a first portion and a second portion. The first portion is connected to the refrigerant inlet to receive refrigerant from the inlet. The first portion has at least one first refrigerant liquid distribution opening and a first refrigerant vapor distribution outlet opening. The second portion is connected to the first portion to receive refrigerant from the at least one first refrigerant liquid distribution opening. The second portion has at least one second refrigerant liquid distribution opening and at least one second refrigerant vapor distribution outlet opening. The heat transferring unit is disposed inside of the shell below the refrigerant distributor to receive liquid refrigerant discharged from the second portion of refrigerant distributor supplied to the heat transferring unit.

These and other objects, features, aspects and advantages of the present invention will become apparent to those skilled in the art from the following detailed description, which, taken in conjunction with the annexed drawings, discloses preferred embodiments.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
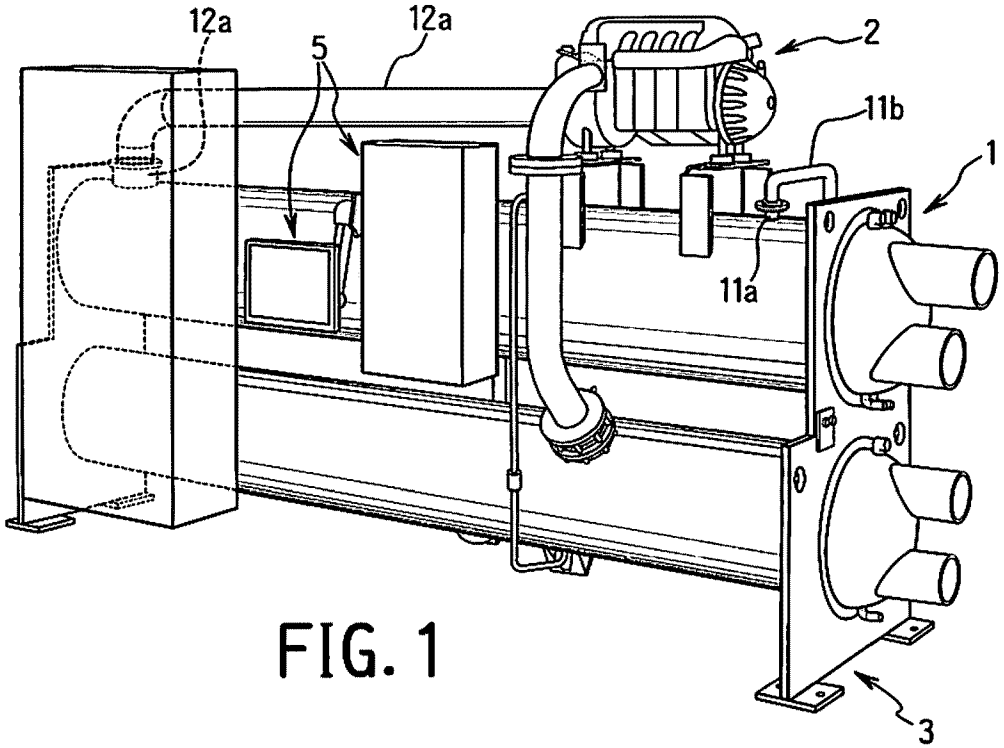
FIG. 1 is a simplified, overall perspective view of a vapor compression system including a heat exchanger according to a first embodiment of the present invention.
Figure 2:
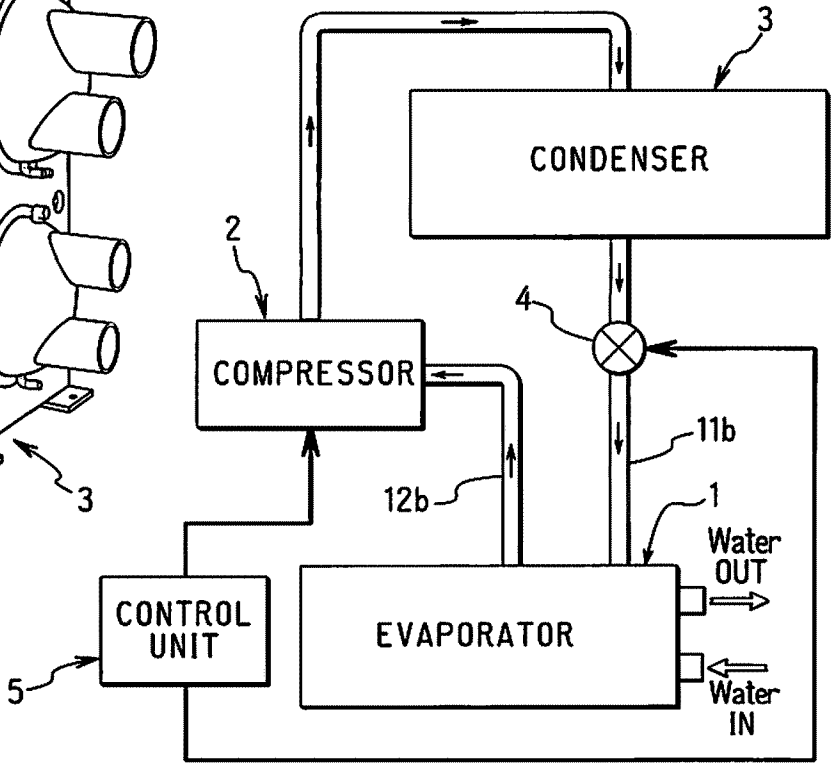
FIG. 2 is a block diagram illustrating a refrigeration circuit of the vapor compression system including the heat exchanger according to the first embodiment of the present invention.

Referring initially to FIGS. 1 and 2, a vapor compression system including a heat exchanger according to a first embodiment will be explained. As seen in FIG. 1, the vapor compression system according to the first embodiment is a chiller that may be used in a heating, ventilation and air conditioning (HVAC) system for air-conditioning of large buildings and the like. The vapor compression system of the first embodiment is configured and arranged to remove heat from liquid to be cooled (e.g., water, ethylene glycol, brine, etc.) via a vapor-compression refrigeration cycle.

As shown in FIGS. 1 and 2, the vapor compression system includes the following four main components: an evaporator 1, a compressor 2, a condenser 3, an expansion device 4, and a control unit 5. The control unit 5 is operatively coupled to a drive mechanism of the compressor 2 and the expansion device 4 to control operation of the vapor compression system.

The evaporator 1 is a heat exchanger that removes heat from the liquid to be cooled (in this example, water) passing through the evaporator 1 to lower the temperature of the water as a circulating refrigerant evaporates in the evaporator 1. The refrigerant entering the evaporator 1 is typically in a two-phase gas/liquid state. The refrigerant at least includes liquid refrigerant. The liquid refrigerant evaporates as the vapor refrigerant in the evaporator 1 while absorbing heat from the water.

The vapor refrigerant is discharged from the evaporator 1 and enters the compressor 2 by suction. In the compressor 2, the vapor refrigerant is compressed to the higher pressure, higher temperature vapor. The compressor 2 may be any type of conventional compressor, for example, centrifugal compressor, scroll compressor, reciprocating compressor, screw compressor, etc.

Next, the high temperature, high pressure vapor refrigerant enters the condenser 3, which is another heat exchanger that removes heat from the vapor refrigerant causing it to condense from a gas state to a liquid state. The condenser 3 may be an air-cooled type, a water-cooled type, or any suitable type of condenser. The heat raises the temperature of cooling water or air passing through the condenser 3. Usually, hot water from the condenser is routed to a cooling tower to reject the heat to the atmosphere. In addition, optionally, the heated water (cooling water that cools the refrigerant) can be used in a building as a hot water supply or to heat the building.

The condensed liquid refrigerant then enters through the expansion device 4 where the refrigerant undergoes an abrupt reduction in pressure. The abrupt pressure reduction results in partial expansion. The expansion device 4 may be as simple as an orifice plate or as complicated as an electronic modulating thermal expansion valve. Whether the expansion device 4 is connected to the control unit will depend on whether a controllable expansion device 4 is utilized. The abrupt pressure reduction usually results in partial expansion of the liquid refrigerant, and thus, the refrigerant entering the evaporator 1 is usually in a two-phase gas/liquid state at a relatively low temperature, low pressure.

Some examples of refrigerants used in the vapor compression system are hydrofluorocarbon (HFC) based refrigerants, for example, R410A, R407C, and R134a, hydrofluoro olefin (HFO), unsaturated HFC based refrigerant, for example, R1234ze, and R1234yf, and natural refrigerants, for example, R717 and R718. R1234ze, and R1234yf are mid density refrigerants with densities similar to R134a. R450A and R513A are mid pressure refrigerants that are also possible refrigerants. A so-called Low Pressure Refrigerant (LPR) R1233zd is also a suitable type of refrigerant. Low Pressure Refrigerant (LPR) R1233zd is sometimes referred to as Low Density Refrigerant (LDR) because R1233zd has a lower vapor density than the other refrigerants mentioned above. R1233zd has a density lower than R134a, R1234ze, and R1234yf, which are so-called mid density refrigerants. The density being discussed here is vapor density not liquid density because R1233zd has a slightly higher liquid density than R134A. While the embodiment(s) disclosed herein are useful with any type of refrigerant, the embodiment(s) disclosed herein are particularly useful when used with LPR such as R1233zd. This is because a LPR such as R1233zd has a relatively lower vapor density than the other options, which leads to higher velocity vapor flow. Higher velocity vapor flow in a conventional device used with LPR such as R1233zd can lead to liquid carryover as mentioned in the Summary above.

R1233zd is not flammable. R134a is also not flammable. However, R1233zd has a global warming potential GWP<10. On the Other hand, R134a has a GWP of approximately 1300. Refrigerants R1234ze, and R1234yf are slightly flammable even though their GWP is less than 10. Therefore, R1233zd is a desirable refrigerant due to these characteristics, non-flammable and low GWP. While individual refrigerants are mentioned above, it will be apparent to those skilled in the art from this disclosure that a blended refrigerant utilizing any two or more of the above refrigerants may be used. For example, a blended refrigerant including only a portion as R1233zd could be utilized.

It will be apparent to those skilled in the art from this disclosure that conventional compressor, condenser and expansion device may be used respectively as the compressor 2, the condenser 3 and the expansion device 4 in order to carry out the present invention. In other words, the compressor 2, the condenser 3 and the expansion device 4 are conventional components that are well known in the art. Since the compressor 2, the condenser 3 and the expansion device 4 are well known in the art, these structures will not be discussed and/or illustrated in detail herein. In addition, it will be apparent to those skilled in the art from this disclosure that the vapor compression system may include a plurality of evaporators 1, compressors 2, condensers 3 and/or expansion devices 4. In other words, the illustrated embodiment merely illustrates one relatively simple example of a vapor compression system in accordance with the present invention.

Referring now to FIGS. 3-10, the detailed structure of the evaporator 1, which is the heat exchanger according to the first embodiment, will be explained. The evaporator 1 basically includes a shell 10, a refrigerant distributor 20, and a heat transferring unit 30. In the illustrated embodiment, the heat transferring unit 30 is a tube bundle. Thus, the heat transferring unit 30 will also be referred to as the tube bundle 30 herein. However, it will be apparent to those skilled in the art from this disclosure that other structures for the heat transferring unit 30 may be used without departing from the scope of the present invention. Refrigerant enters the shell 10 and is supplied to the refrigerant distributor 20. Then refrigerant distributor 20 performs gas liquid separation and supplies the liquid refrigerant onto the tube bundle 30, as explained in more detail below. Vapor refrigerant will exit the distributor 20 and flow into the interior of the shell 10, as also explained in more detail below.

Figure 3:
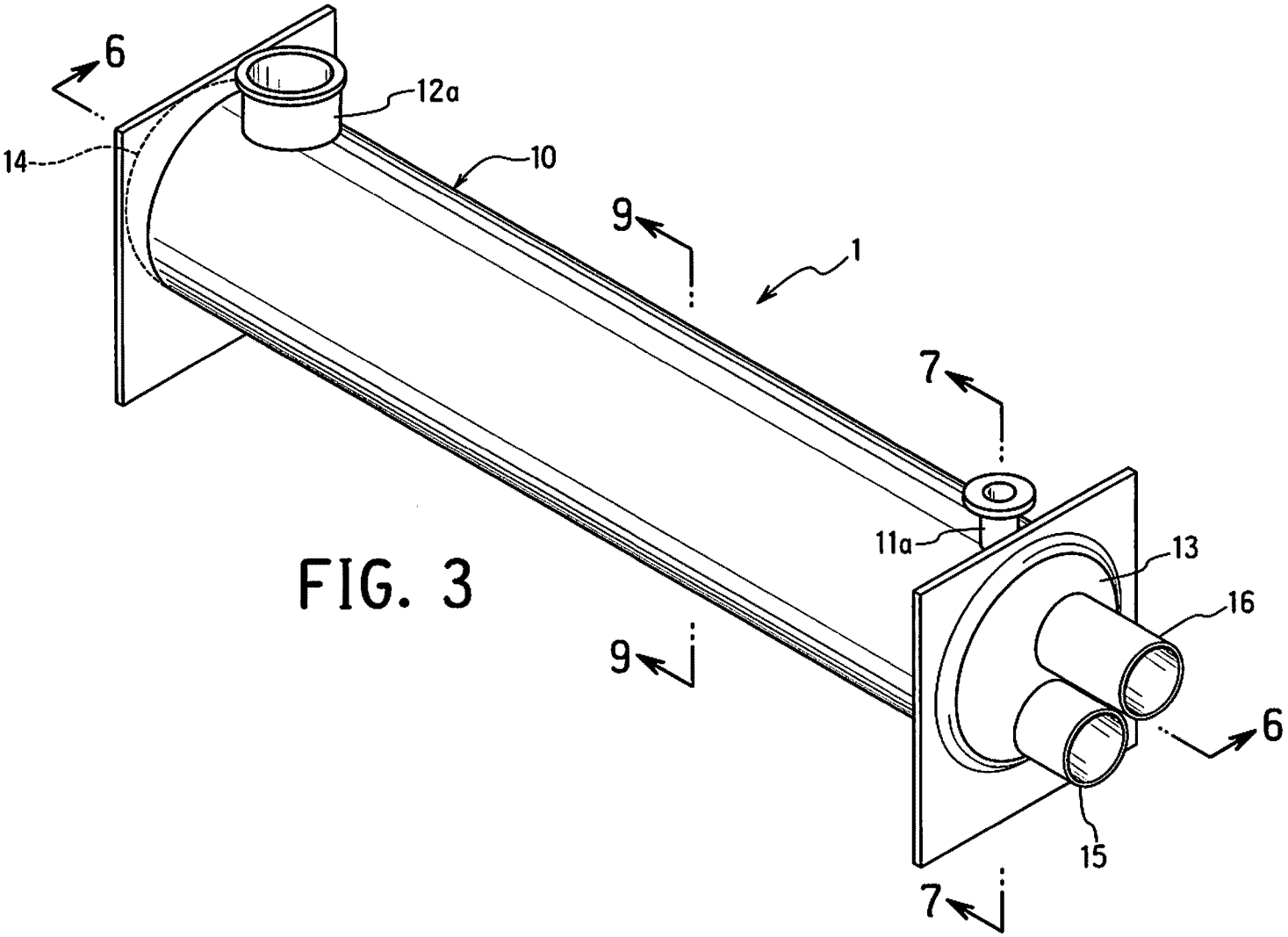
FIG. 3 is a simplified perspective view of the heat exchanger according to the first embodiment of the present invention.
Figure 6:
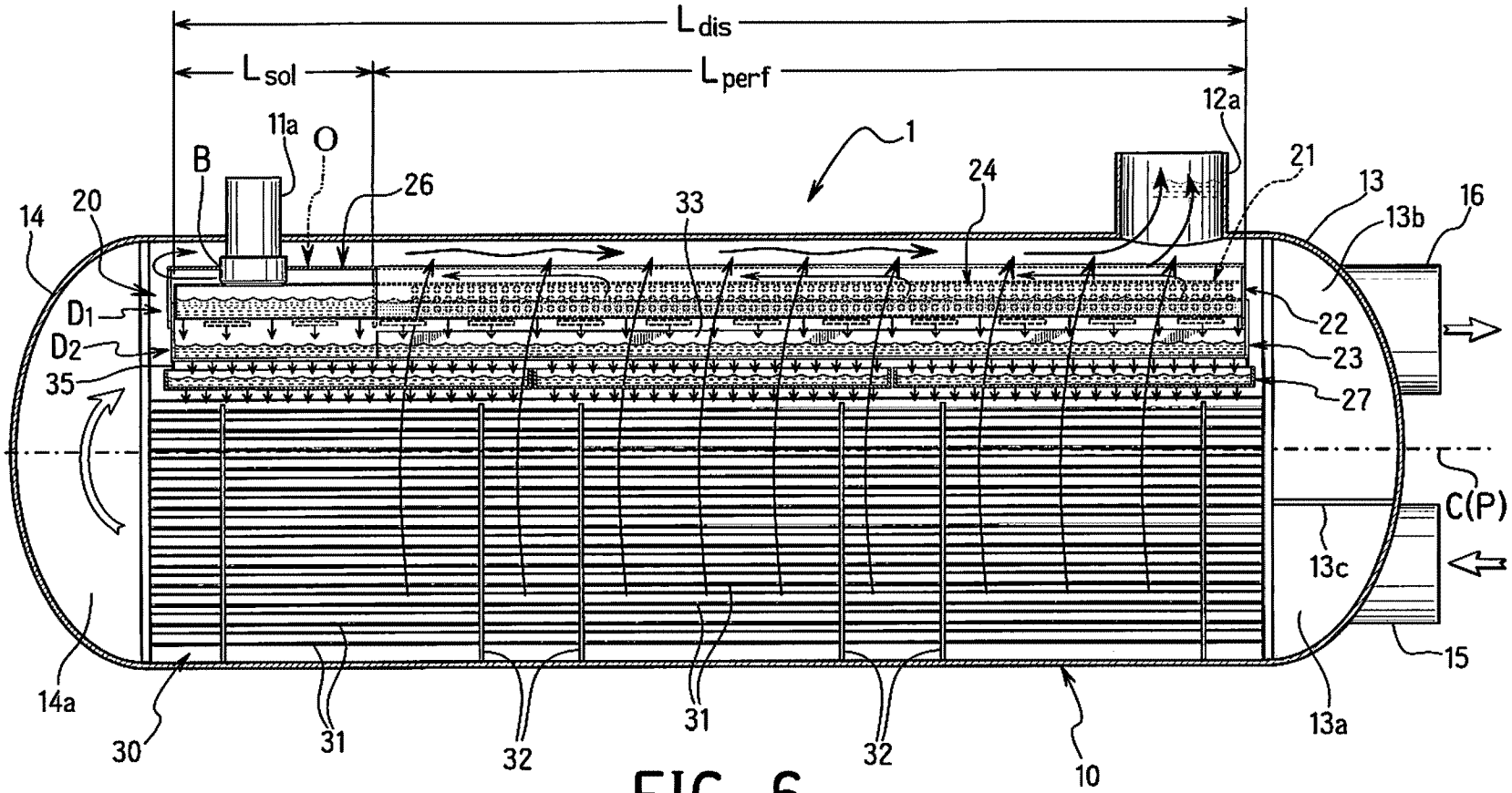
FIG. 6 is a simplified longitudinal cross sectional view of the heat exchanger illustrated in FIGS. 1-3, as taken along section line 6-6 in FIG. 3.
Figure 7:
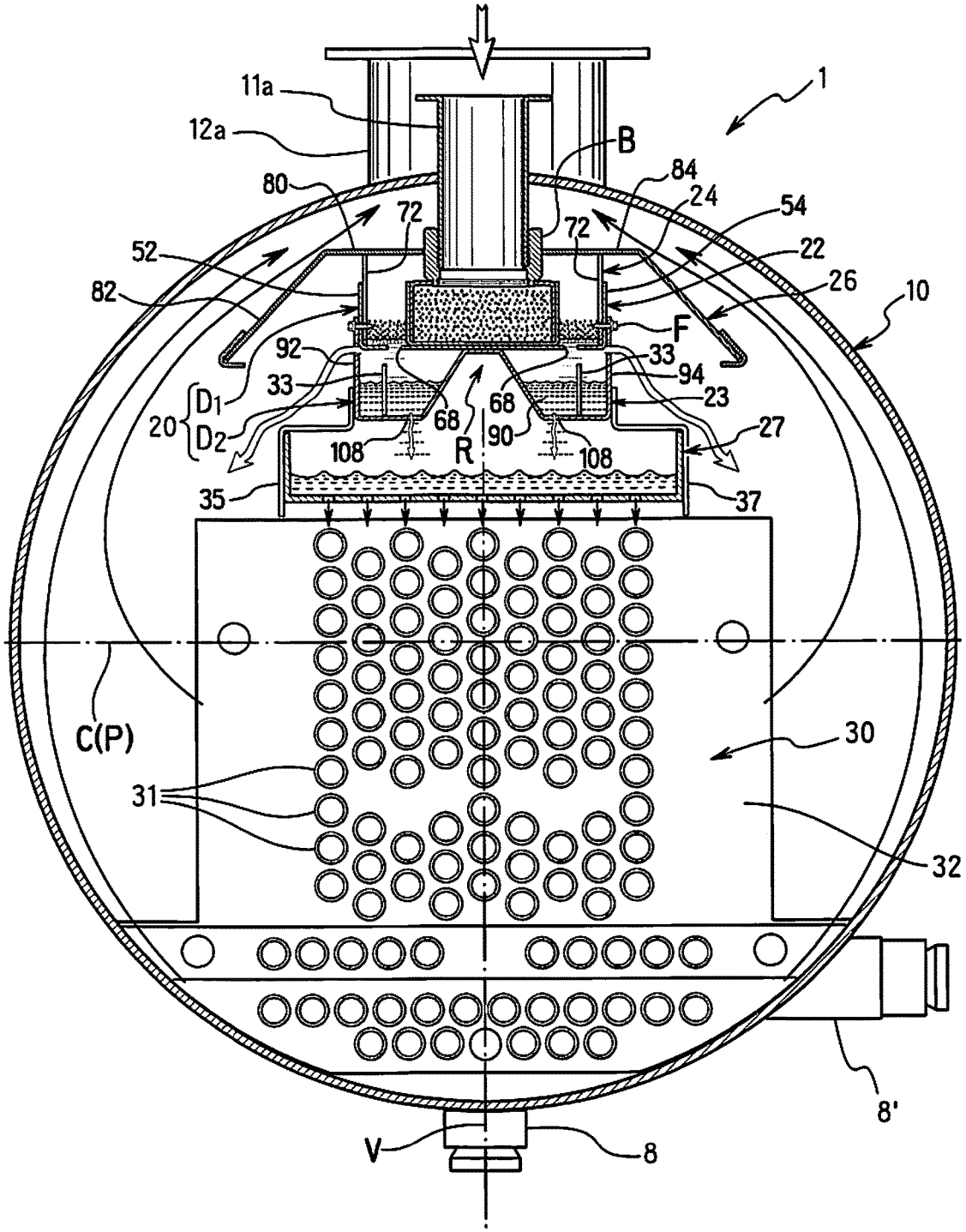
FIG. 7 is a simplified transverse cross sectional view of the heat exchanger illustrated in FIGS. 1-3, as taken along section line 7-7 in FIG. 3.

As best understood from FIGS. 3, 6 and 7, in the illustrated embodiment, the shell 10 has a generally cylindrical shape with a longitudinal center axis C (FIG. 6) extending generally in the horizontal direction. Thus, the shell 10 extends generally parallel to a horizontal plane P. The shell 10 includes a connection head member 13 defining an inlet water chamber 13*a* and an outlet water chamber 13*b*, and a return head member 14 defining a water chamber 14*a*. The connection head member 13 and the return head member 14 are fixedly coupled to longitudinal ends of a cylindrical body of the shell 10. The inlet water chamber 13*a* and the outlet water chamber 13*b* are partitioned by a water baffle 13*c*. The connection head member 13 includes a water inlet pipe 15 through which water enters the shell 10 and a water outlet pipe 16 through which the water is discharged from the shell 10.

As shown in FIGS. 1-3 and 6, the shell 10 further includes a refrigerant inlet 11*a* connected to a refrigerant inlet pipe 11*b* and a shell refrigerant vapor outlet 12*a* connected to a refrigerant outlet pipe 12*b*. The refrigerant inlet pipe 11*b* is fluidly connected to the expansion device 4 to introduce the two-phase refrigerant into the shell 10. The expansion device 4 may be directly coupled at the refrigerant inlet pipe 11*b*. The liquid component in the two-phase refrigerant boils and/or evaporates in the evaporator 1 and goes through phase change from liquid to vapor as it absorbs heat from the water passing through the tube bundle 30. The vapor refrigerant is drawn through the refrigerant outlet pipe 12*b* to the compressor 2 by suction. The refrigerant that enters the refrigerant inlet 11*a* includes at least liquid refrigerant. Often the refrigerant entering the refrigerant inlet 11*a* is two-phase refrigerant. From the refrigerant inlet 11*a* the refrigerant flows into the refrigerant distributor 20, which distributes the liquid refrigerant over the tube bundle 30.

Figure 4:
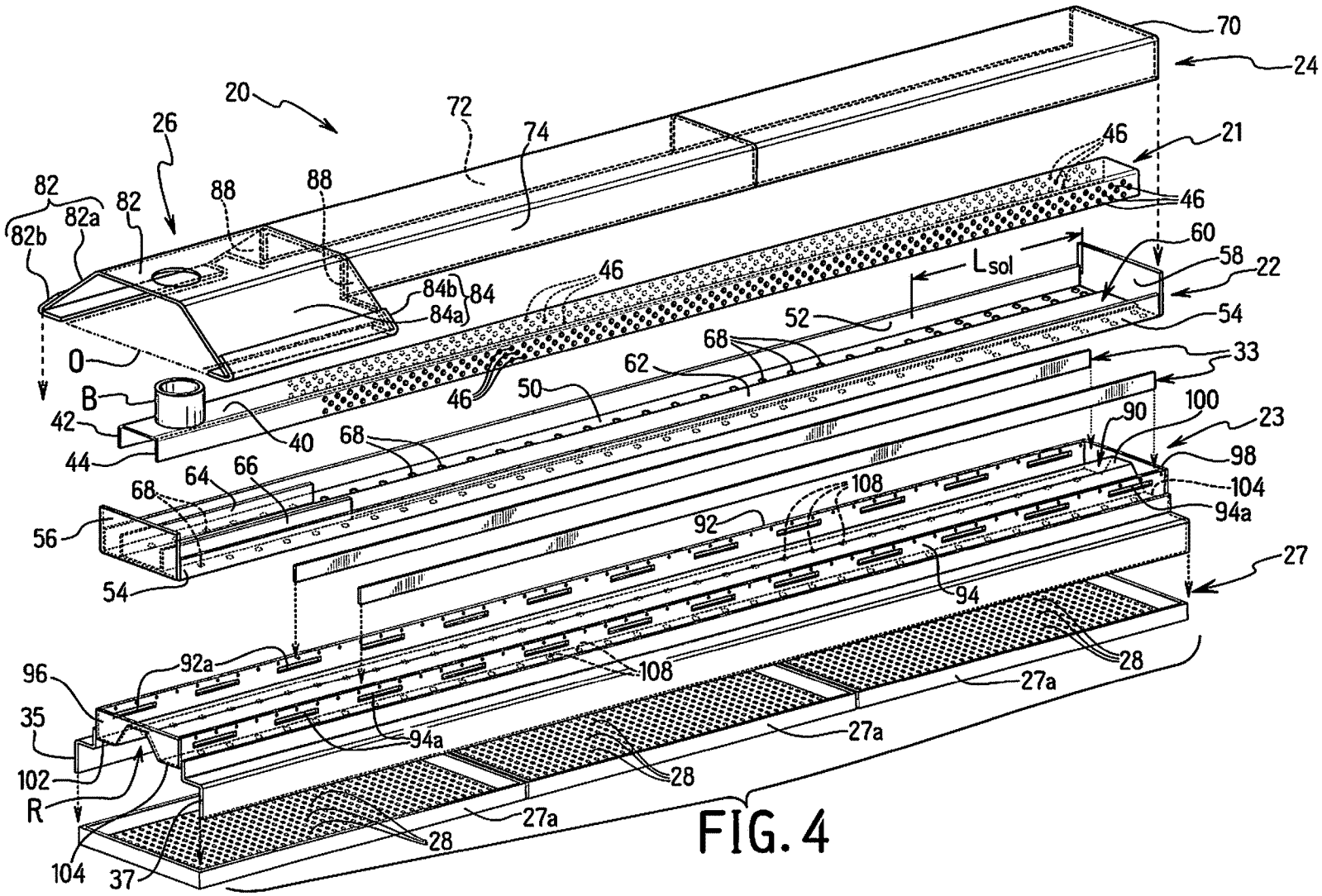
FIG. 4 is a simplified exploded perspective view of an internal structure of the refrigerant distributor of the heat exchanger illustrated in FIGS. 1-3.
Figure 5:
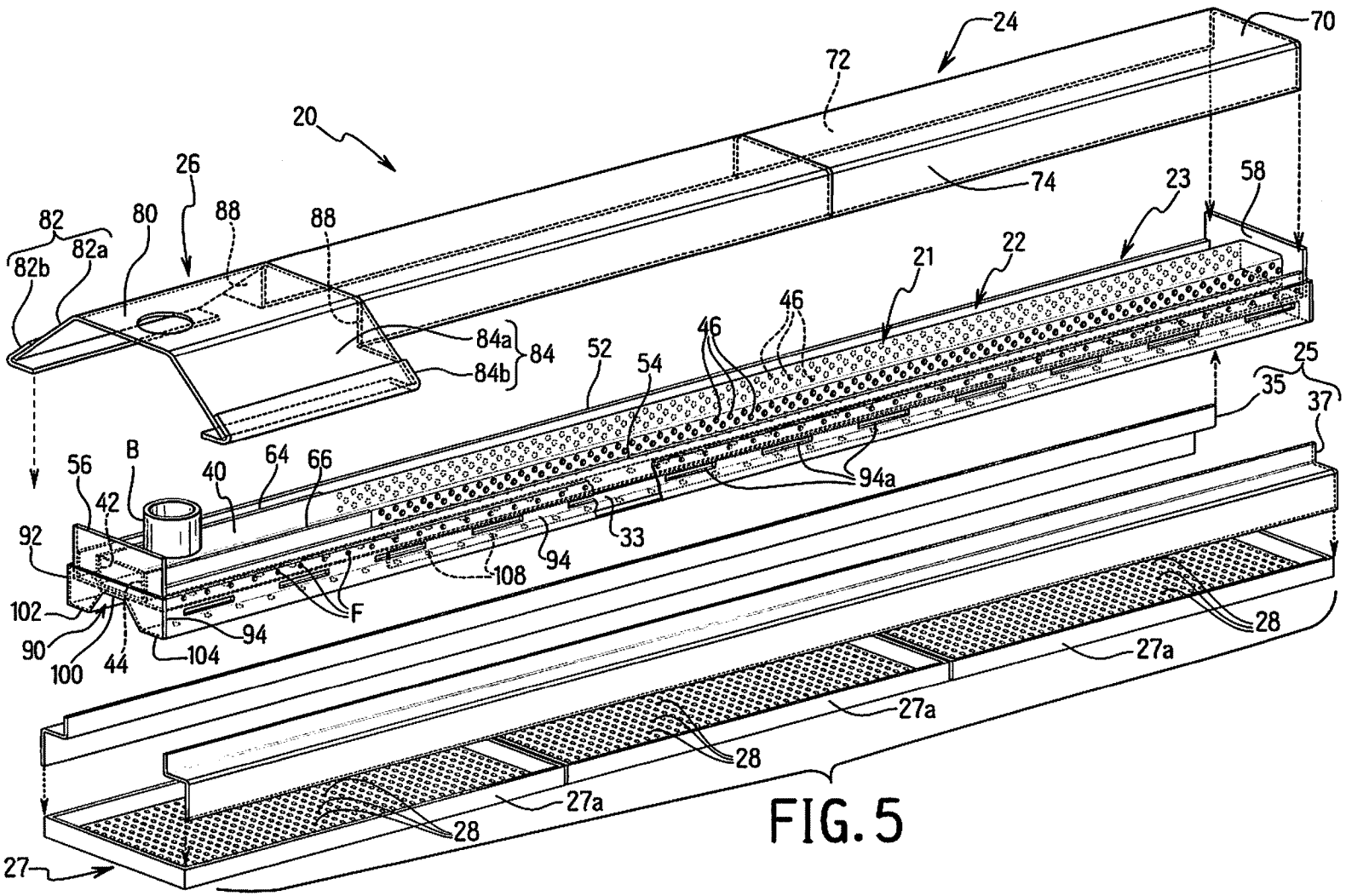
FIG. 5 is a simplified partially exploded perspective view of the internal structure of the refrigerant distributor of the heat exchanger illustrated in FIGS. 1-4.

Referring now to FIGS. 4-9, the refrigerant distributor 20 will now be explained in more detail. The refrigerant distributor 20 is connected to the refrigerant inlet 11*a* and is disposed within the shell 10. The refrigerant distributor 20 is configured and arranged to serve as both a gas-liquid separator and a liquid refrigerant distributor. The refrigerant distributor 20 extends longitudinally within the shell 10 generally parallel to the longitudinal center axis C of the shell 10. As best shown in FIGS. 4-5, the refrigerant distributor 20 includes an inlet channel part 21, a first tray part 22, a second tray part 23, a first canopy part or first cover part 24, a second canopy part 25, and a shroud 26. A third tray part 27 is mounted below the second tray part 23, and may be considered part of the distributor 20 or may be considered a separate part from the distributor 20. The inlet channel part 21, the first tray part 22, the second tray part, the first canopy part 24 and the shroud 26 are rigidly connected together as best understood from FIGS. 5-9. The third tray part 27 is disposed below the second tray part 23 in a slightly vertically spaced arrangement.

As shown in FIG. 6, the inlet channel part 21 extends generally parallel to the longitudinal center axis C of the shell 10 and the horizontal plane P. The inlet channel part 21 is fluidly connected to the refrigerant inlet pipe 11*b* via the refrigerant inlet 11*a* of the shell 10 so that the two-phase refrigerant is introduced into the inlet channel part 21. The inlet channel part 21 has an inverted U-shaped rectangular cross-sectional configuration. More specifically, the inlet channel part 21 has an inverted U-shape with its laterally spaced free ends fixedly connected to the first tray part 22. In the illustrated embodiment, the first tray part 22 has a structure that mates with the inlet channel part 21 to form part of tubular cross-sectional shape together with the inlet channel part 21.

Referring again to FIGS. 4-9, the inlet channel part 21 is fluidly connected to the refrigerant inlet pipe 11*b* via the refrigerant inlet 11*a* so that the two-phase refrigerant is introduced into the inlet channel part 21 from the refrigerant inlet pipe 11*b* as mentioned above. The inlet channel part 21 preferably includes an inlet top part or wall (plate) 40 and a pair of inlet lateral side parts or walls (plates) 42 and 44, as best seen in FIG. 4. The inlet top plate 40 has a bushing B with hole where the refrigerant inlet 11*a* is attached. The bushing B is mounted in a hole of the top plate 40. The inlet lateral side plates 42 and 44 extend downwardly from the inlet top plate 40 to form an inverted U-shaped transverse cross-section. The inlet lateral side plates 42 and 44 can be divided into first sections without holes and second sections with holes 46. While individual holes 46 are illustrated, the second sections can be perforated or be formed of a mesh material. The inlet lateral side plates 42 and 44 are attached to the first tray part 22.

In the illustrated embodiment, the inlet top plate 40 and the inlet side plates 42 and 44 are each formed of a rigid metal sheet/plate material, which prevents liquid and gas refrigerant from passing therethrough unless holes 46 or perforation is formed therein. In addition, in the illustrated embodiment, the inlet top plate 40 and the inlet side plates 42 and 44 are integrally formed together as a one-piece unitary member. However, it will be apparent to those skilled in the art from this disclosure that these plates 40, 42 and 44 may be constructed as separate members, which are attached to each other using any conventional technique such as welding. In either case, the inlet plates 42 and 44 are attached to the longitudinal center of the first tray part 22. In addition, it will be apparent to those skilled in the art from this disclosure that at least portions of each of the lateral side plates 42 and 44 could be constructed at least partially of a metal mesh material or any suitable perforated material so long as liquid and gas communication therethrough is possible.

Referring again to FIGS. 4-9, the first tray part 22 will now be explained in more detail. The first tray part 22 includes a first bottom side part or wall (plate) 50, a pair of first lateral side parts or walls (plates) 52 and 54, a pair of first end parts or walls (plates) 56 and 58 and a channel section 60, as best seen in FIG. 4. In the illustrated embodiment, the first lateral side plates 52 and 54 extend upwardly from the first bottom plate 50 to form a U-shape in transverse cross-section. The first end plates 56 and 58 are attached at opposite longitudinal ends of the first bottom plate 50 and the first lateral side plates 52 and 54. The channel section 60 is attached to a lateral center of the first bottom plate 50. In the illustrated embodiment, each of the first bottom plate 50, the pair of first lateral side plates 52 and 54, the pair of first end plates 56 and 58 and the channel section 60 are constructed of metal sheet/plate material. In the illustrated embodiment, the bottom plate 50 and the pair of lateral side plates 52 and 54 are integrally formed as a one-piece, unitary member. On the other hand, in the illustrated embodiment, the end plates 56 and 58 are formed as separate members that are attached to the longitudinal ends of the bottom plate 50 and the pair of lateral side plates 52 and 54 by welding or any other suitable technique.

The channel section 60 includes a planar part 62 attached to the first bottom plate 50 and laterally spaced apart flange parts 64 and 66 extending upwardly from the planar part 62 to form a trough therebetween, as best seen in FIG. 4. The trough and the inlet channel part 21 are sized and shaped so that the inlet channel part 21 is received in the trough between the flange parts 64 and 66 so that a rectangular cross-sectional shape is formed by the inlet channel part 21 and the first bottom plate 50. The inlet channel part 21 is preferably fixedly attached to the planar part 62. In the illustrated embodiment, each of the flange parts 64 and 66 is disposed where the refrigerant inlet 11*a* is disposed to provide support and because no refrigerant flows out of the inlet channel part 21 at this location. Optionally, additional flange tabs that are smaller than the flanges 64 and 66 can be disposed in a longitudinally spaced arrangement along the planar part 62 to be useful in positioning the inlet channel part 21 during assembly, without significantly impeding refrigerant flow out of the inlet channel part 21 after assembly.

In the illustrated embodiment, the channel section 60 with the flange parts 64 and 66 is a separate member from the bottom plate 50. However, it will be apparent to those skilled in the art from this disclosure that the flange parts 64 and 66 can be integrally formed with the first bottom plate 50, or can be separate flanges that are fixed to the first bottom plate 50 (e.g., by welding). In addition, it will be apparent to those skilled in the art from this disclosure that the planar part 62 can be omitted and the inlet channel part 21 can be directly attached to the first bottom plate 50. In any case, channel section 60 (and/or the base plate 50 where the channel section 21 is mounted) is preferably free of openings in the planar part 62 thereof. The first base plate 50 in a lateral center is also preferably free of openings. Thus, regardless of whether the planar part 62 is provided, refrigerant will have to flow out of the holes 46 of the inlet channel part 21 and into the first tray part 22. On the other hand, the areas of the first base plate 50 on opposite lateral sides of the channel section 60 have holes 68 formed therein to pass liquid refrigerant to the second tray part 23. More specifically, there are a larger number of the holes 68 disposed inwardly of a smaller number of the holes 68 to pass liquid to inner and outer areas of the second tray part 23, as explained in more detail below. Even more specifically, as best seen in FIG. 4 the larger number of inward holes 68 extend the entire length of the distributor 20, and the smaller number of the holes 68 are disposed only at the end of the distributor 20 remote from the refrigerant inlet 11*a*, as discussed in more detail below.

Preferably the end plates 56 and 58 are connected to the base plate 50 and the lateral side plates 52 and 54 in a sealed (i.e., air/liquid tight) manner. Likewise, the inlet channel part 21 is preferably attached to the channel section 60 and the end plates 56 and 58 in a sealed (i.e., air/liquid tight) manner. However, it will be apparent to those skilled in the art from this disclosure that tight fitting connections with minor leakage from the connection points or seams joining these parts may be permissible as long as liquid and/or gas flow due to leakage does not impact performance. One suitable technique for making such connections is welding. Thus, refrigerant flowing into the rectangular passage formed by the inlet channel part 21 and the channel section 60 will remain therein except for when exiting from the holes 46 formed in the lateral side plates 42 and 44.

Referring still to FIGS. 4-9, the first canopy part 24 will now be explained in more detail. The first canopy part 24 is an inverted U-shaped member formed of solid sheet/plate material. In the illustrated embodiment, the first canopy part 24 is formed of two sections welded together. In other words, a seam (not numbered) is shown in the drawings. However, it will be apparent to those skilled in the art from this disclosure that the first canopy part 24 could be formed of a single section. In the illustrated embodiment, the first canopy part 24 includes a cover top part or wall (plate) 70 and a pair of cover lateral side parts or walls (plates) 72 and 74 extending downwardly from the cover top plate 70 to form an inverted U-shape in transverse cross-section. A width between the pair of cover lateral side plates 72 and 74 is slightly smaller than a width between the first lateral side plates 52 and 54 of the first tray part 22 so the first canopy part 24 can be mounted in the first tray part 22.

In the illustrated embodiment, the pair of cover lateral side plates 72 and 74 are integrally formed with the cover top plate 70 (e.g., formed as a flat plate then bent downwardly). The first canopy part 24 is attached to the first tray part 22 to enclose the top thereof. Specifically, the cover top plate 70 is attached to the first end plate 58. In addition, the pair of cover lateral side plates 72 and 74 are attached to the first lateral side plates 52 and 54, respectively. The pair of cover lateral side plates 72 and 74 are also attached to the first end plate 58. More specifically, because the width between the pair of cover lateral side plates 72 and 74 is slightly smaller than a width between the first lateral side plates 52 and 54 of the first tray part 22, the cover lateral side plates 72 and 74 are attached in positions laterally inside of the first lateral side plates 52 and 54.

The connections between these parts, like other connections discussed above are preferably sealed (i.e., air/liquid tight) connections. However, it will be apparent to those skilled in the art from this disclosure that tight fitting connections with minor leakage from the connection points or seams joining these parts may be permissible as long as liquid and/or gas flow due to leakage does not impact performance. One example of a suitable connection is welding.

In the illustrated embodiment, the first canopy part 24 preferably has a longitudinal length as long as or longer than the second inverted U-shaped section of the inlet channel part 21 having the holes 46. In addition, the first canopy part 24 preferably has a lateral width slightly narrower than a lateral width of the first tray part 22, and a height at least as tall as the lateral side walls of the first tray part 22. Furthermore, the first canopy part 24 preferably has a height taller than a height of the inlet channel part 21 to form a gas passage thereunder. When the first canopy part 24 is attached to the first tray part 22, a rectangular enclosed chamber is formed that extends from the first end plate 58 to a spaced end of the first canopy part 24. The spaced end of the first canopy part 24 is attached to the shroud 26 as explained below in more detail. The area of the distributor 20 extending from the spaced end of the first canopy part 24 (where the shroud is attached) to the first end plate 58 that is above the first tray part 22 and the inlet channel part 21 adjacent the refrigerant inlet 11*a* forms a first refrigerant vapor distribution outlet O. The holes 68 distribute liquid refrigerant into the second tray part 23. The first refrigerant vapor distribution outlet O distributes gas refrigerant into an interior of the shell 10 before the gas refrigerant exits through the shell vapor outlet 12*a*. This gas/liquid refrigerant separation/distribution is a first stage of gas/liquid separation/distribution carried out by the distributor 20.

Figure 8:
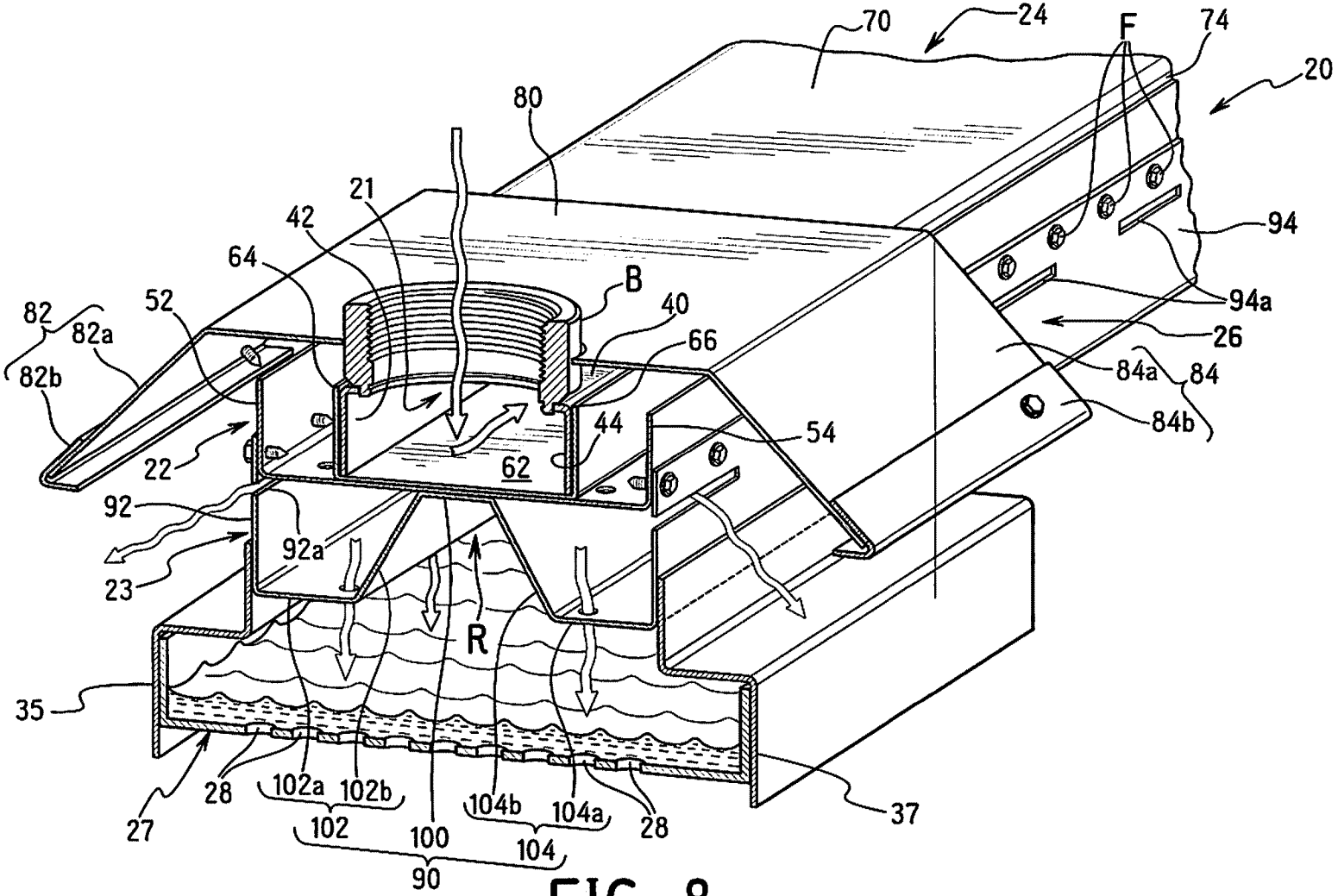
FIG. 8 is a further enlarged partial perspective view of an inlet end of the distributor illustrated in FIGS. 4-7, along section line 7-7 of FIG. 3.
Figure 9:
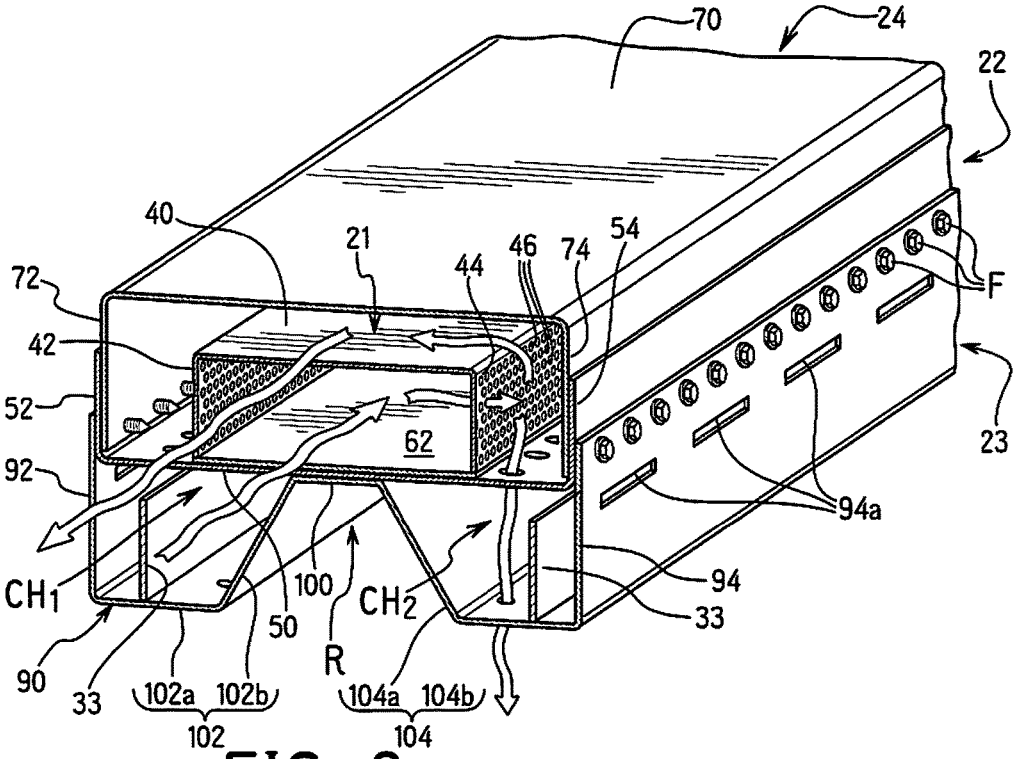
FIG. 9 is a further enlarged partial perspective view of an area spaced from the inlet end of the distributor illustrated in FIGS. 4-7, along a middle section line 9-9 of FIG. 3 spaced from the section line 7-7.

Referring still to FIGS. 4-9, the second tray part 23 will now be explained. The second tray part 23 is attached to a bottom of the first tray part 22 and receives liquid refrigerant from the holes 68. The second tray part 23 basically includes a bottom lateral part or wall (plate) 90, a pair of lateral side parts or walls (plates) 92 and 94 extending upwardly from the bottom lateral wall 90, and end parts or walls (plates) 96 and 98 attached to opposite longitudinal ends of the lateral wall 90 and opposite longitudinal ends of the lateral side walls plates 92 and 94. The second tray part 23 has a generally U-Shaped configuration, except a recess R projects upwardly. Due to this arrangement of the recess R, the bottom lateral wall (plate) 90 and the lateral side walls (plates) 92 and 94 together form a substantially W-shaped cross-sectional shape as best seen in FIGS. 7-9.

In addition, a pair of vertical divider plates 33 are mounted on opposite sides of the recess R to divide the troughs on opposite sides of the recess R. The vertical plates 33 are separate members constructed of rigid sheet/plate material such as metal (e.g. the same material as the second tray part 23) that are fixed to the bottom lateral part 90 by welding or any suitable technique. The divider plates 33 have heights approximately ¾ of the height of the second tray part 23. The smaller number of the holes 68 in the first tray part 22 are located to feed liquid to the outer sides of the divider plates 33 while the larger number of the holes 68 are located to feed liquid to the inner sides of the divider plates 33, as best understood from FIGS. 4 and 10. The divider plates 33 separate each of the troughs of the second tray part 23 into inner and outer duct sections. The inner duct sections are closer to the recess R than the outer duct sections. However, these inner and outer duct sections communicate at the shroud end of the distributor 20, as best understood from FIGS. 4-5. Thus, the larger number of inward holes 68 are located to feed refrigerant to the inner duct sections of the second tray part 23, and the smaller number of the outward holes 68 are located to feed refrigerant to the outer duct sections of the second tray part 23 only at the end of the distributor 20 remote from the refrigerant inlet 11*a*.

In the illustrated embodiment, the bottom lateral wall (plate) 90 and the lateral side walls (plates) 92 and 94 are integrally formed with each other as a one-piece unitary plate member (e.g., as a flat plate that is then bent into the illustrated shape). On the other hand, the end plates 96 and 98 are separate members that are attached to opposite longitudinal ends of the bottom lateral wall (plate) 90 and the lateral side walls (plates) 92 and 94. However, it will be apparent to those skilled in the art from this disclosure that the lateral side plates 92 and 94 could be formed separately from the bottom lateral plate and/or the end plates 96 and 98 could be formed integrally. In any event, the connections between these parts, like other connections discussed above are preferably sealed (i.e., air/liquid tight) connections. However, it will be apparent to those skilled in the art from this disclosure that tight fitting connections with minor leakage from the connection points or seams joining these parts may be permissible as long as liquid and/or gas flow due to leakage does not impact performance. One example of a suitable connection is welding.

The second tray part 23 has a perimeter size slightly larger than a perimeter size of the first tray part 22. Thus, the second tray part 23 can partially vertically overlap with the first tray part 22 and be attached to exterior face(s) of the first tray part 22. More specifically, in the illustrated embodiment, the pair of lateral side walls (plates) 92 and 94 are attached to the pair of first lateral side plates 52 and 54, respectively, using a plurality of longitudinally arranged fasteners F as best understood from FIGS. 4-5. The fasteners can be any suitable fasteners such as screws, bolts, rives etc. Alternatively, it will be apparent to those skilled in the art from this disclosure that the second tray part 23 could be attached to the first tray part 22 using welding or any other suitable joining technique. Preferably, the first and second tray parts 22 and 23 are attached in an air/liquid tight manner or at least a tight fitting manner such that minimal vapor/liquid passes between the parts, like the other connections discussed above.

Figure 10:
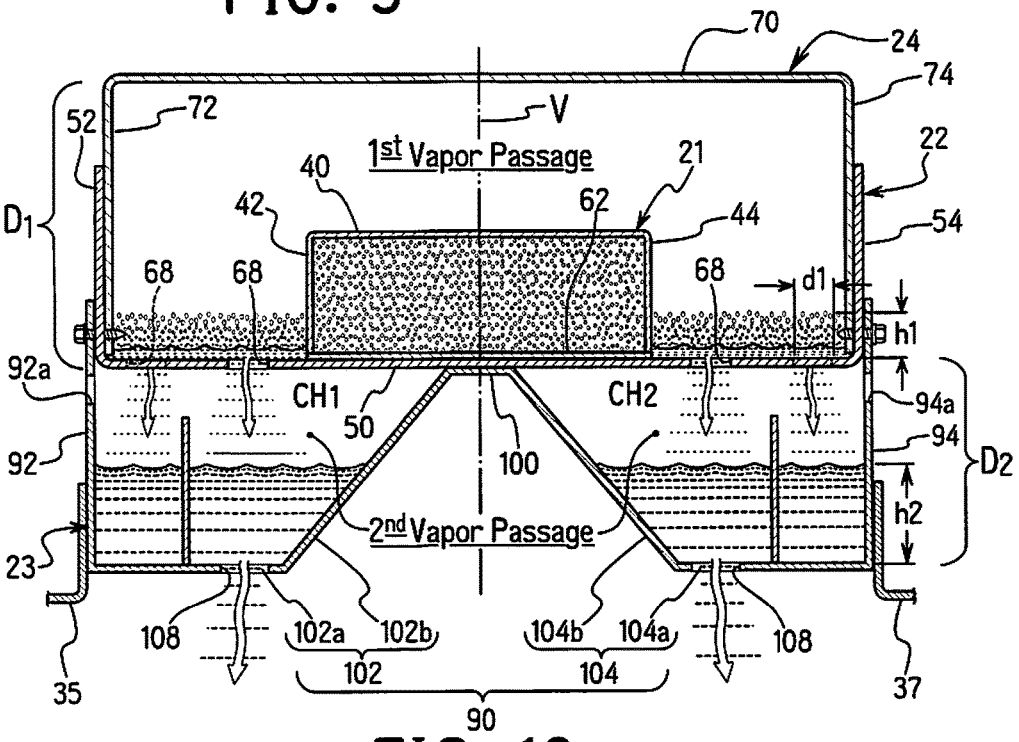
FIG. 10 is a cross-sectional view of the distributor of FIG. 9, along middle section line 9-9 of FIG. 3 in order to illustrate liquid/vapor heights and hole diameters.

Referring still to FIGS. 4-9, the bottom lateral wall 90 includes a recessed section 100, a pair of lateral sections 102*a* and 104*a*, and a pair of inner sections 102*b* and 104*b*. The lateral sections 102*a* and 104a extend toward each other from the side walls 92 and 94, respectively. The inner sections 102*b* and 104*b* extend upwardly from the lateral sections 102*a* and 104*a* to the recessed section 100. In the illustrated embodiment, the inner sections 102*b* and 104*b* are inclined relative to the horizontal plane P and inclined relative to a vertical direction V (FIG. 7) perpendicular to the horizontal plane P (FIGS. 8-10). The recessed section 100 contacts an underside of the first tray part 22 (i.e., a bottom surface of the base plate 50). Thus, the recessed section 100 serves to vertically position the second tray part 23 relative to the first tray part 22.

The recessed section 100 can be attached to the base plate 50 or may merely contact the base plate 50. In either case, the recess R (recessed section 100) divides the lateral wall 90 into a pair of segments, with each segment including a lateral section 102*a* or 104*a* and an inner section 102*b* or 104*b* extending upwardly from the lateral section 102*a* or 104*a*. In addition, the recess R (recessed section 100) divides an interior space of the second tray part at or below the recessed section 100 into a pair of second distribution channels CH1 and/or CH2. The lateral sections 102*a* or 104*a* each have a plurality of holes 108 formed therein that are second refrigerant liquid distribution openings. Thus, at least one of the second refrigerant liquid distribution openings 108 is formed in each of the lateral sections 102*a* or 104*a* of the distribution channels CH1 and/or CH2. Upper ends of the inner sections 102*b* and 104*b* are connected to each other by the recessed section 100. In the illustrated embodiment, the holes 108 are only located inward of the divider plates 33 adjacent the recess R. Thus refrigerant received in the second tray part 23 outward of the divider plates 33 need to flow around the divider plates 33 to the holes 108. Momentum of the liquid may carry more liquid to the back of the distributor than desired. The outer set of holes 68 on the outward side can collect and drain this liquid into the outer ducts of the second tray part 23, which can form outer "bleed off lines" formed by the divider plate 33 to the drain holes that are not separated using the divider plates 33.

Each of the sidewalls 92 and 94 includes a plurality of second vapor distribution outlet openings 92*a* and 94*a*, respectively, formed therein. In the illustrated embodiment, the second vapor distribution outlet openings 92*a* and 94*a* are positioned slightly below the recessed section 100 so as to be position slightly below the base plate 50 at upper ends of the distribution channels CH1 and/or CH2. Thus, the shell refrigerant vapor outlet 12*a* is separate from the first and second refrigerant vapor distribution outlet openings O, 92*a* and 94*a* of the distributor 20 to distribute refrigerant vapor exiting the first and second refrigerant vapor distribution outlet openings O, 92*a* and 94*a* into an interior of the shell before the refrigerant vapor flows out of the shell refrigerant vapor outlet 12*a*. The second refrigerant vapor distribution outlet openings 92*a* and 94*a* are longitudinally extending slots disposed at upper ends of the side walls 92 and 94, respectively.

Referring to FIGS. 4-8, the second canopy member 25 includes a pair of laterally spaced canopy plates 35 and 37. In the illustrated embodiment, each canopy plate has a zig-zag configuration so as to be attached to the second tray part 23 and to fit over the third tray part 27 in a mating arrangement. However, it will be apparent to those skilled in the art from this disclosure that other shapes may be used. The second canopy part 25 serves to prevent high speed vapor from entraining liquid from the third tray part 27 and bring such liquid out into the interior of the shell 10 on the outside of the distributor 20. Each of the canopy plates 35 and 37 is are constructed of metal sheet/plate material such as metal. In the illustrated embodiment, each of the canopy plates 35 and 37 is attached to an outer side of the second tray part 23 by welding or any other suitable technique. Thus, the canopy plates 35 and 37 (the second canopy member 25) can be considered part of the second tray part 23 or can be considered a separate part. The canopy plates 35 and 37 extend along the entire length of the distributor 20.

Referring still to FIGS. 4-8, the shroud 26 at least partially overlies the first refrigerant vapor distribution outlet opening O. In particular, the shroud 26 overlies the top of the first refrigerant vapor distribution outlet opening O to divide the opening O into two laterally spaced section (unnumbered). The shroud 26 has a shroud top plate 80 and a pair of side shroud plates 82 and 84 extending downwardly from the top shroud plate 80 to form a substantially inverted U shaped configuration. In addition, the shroud 26 preferably includes end plates 88 on an end of the shroud top plate 80 attached to the canopy member 24. The shroud 26 is attached to the first tray part 22 and the first canopy part 24 by attaching the shroud top plate 80 to the first end plate 56 and the spaced end of the first canopy part 24 using any suitable attachment technique. Welding is one example of a suitable attachment technique.

Each shroud side plate 82 and 84 includes an inclined section 82*a* and 84*a* extending from the shroud top plate 80, and V-shaped tab members 82*b* and 84*b* extend upwardly and inwardly from lower ends of vertical section 82*b* and 84*b* to form V-channels at bottom ends thereof, respectively. Due to this configuration of the shroud 26, refrigerant vapor will not flow vertically up out of the first refrigerant vapor distribution outlet opening O, but will have to flow either laterally sideways and/or downwardly out of the first refrigerant vapor distribution outlet opening O before flowing to the shell vapor outlet 12*a*. When doing visualization it was seen that whey carry over occurs, high speed liquid collides into the inclined sections 82*a* and 84*a*. However, the V-shaped tab members 82*b* and 84*b* collect any of these droplets and drain them to the end of the shroud 26.

The elements of the shroud 26 are preferably constructed of rigid sheet/plate material such as sheet metal. The shroud top plate 80 and the pair of side shroud plates 82 and 84 can be constructed as a single member that is bent into the shape illustrated herein. However, in the illustrated embodiment, the end plates 88 are preferably constructed as separate members that are attached to the shroud top plate 80 and the pair of side shroud plates 82 and 84 using any suitable conventional technique such as welding. In addition, in the illustrated embodiment, V-shaped tab members 82*b* and 84*b* are constructed as separate members that are attached to the pair of side shroud plates 82 and 84 using any suitable conventional technique such as bolting (FIG. 8) or welding (remaining FIGS). In addition, the shroud 26 in the illustrated embodiment is welded to the parts of the distributor 20 along the intersections (e.g., seams) in a tight fitting and/or air/liquid tight arrangement like the other connections of the distributor 20 described above. The shroud 26 may assist in limiting liquid carryover to the shell vapor refrigerant outlet 12*a*.

As best shown in FIGS. 4-8, the third tray part 27 will now be explained in more detail. The third tray part 27 includes three identical tray sections 27*a* that are aligned side-by-side along the longitudinal center axis C of the shell 10. As shown in FIG. 5, an overall longitudinal length of the three third tray parts 27*a* is substantially the same as or slightly larger than a longitudinal length of the second tray part 23 as shown in FIG. 5. Thus, refrigerant dripping from the second tray part 23 will fall into the third tray part 27. A transverse width of the third tray part 27 is set to be larger than a transverse width of the second tray part 23 so that the third tray part 27 extends over substantially an entire width of the tube bundle 30 as shown in FIG. 7. As shown in FIGS. 5-6, each of the third tray parts 27*a* has a plurality of third discharge apertures 28 from which the liquid refrigerant is discharged downwardly toward the tube bundle 30. Thus, the refrigerant distributor 20 can be considered to have at least one third liquid refrigerant distribution opening 28 if the third tray part 27 is considered part of the distributor 20 to distribute liquid refrigerant. The third tray part 27 is preferably supported by the heat transferring unit 30, as explained below.

Referring again to FIGS. 3-9, the combination of and cooperation between the parts of the distributor 20 will now be discussed in more detail. In the illustrated embodiment, the inlet channel part 21, the first tray part 22, and the first canopy part 24 preferably form parts of a first portion D1 of the refrigerant distributor 20 connected to the refrigerant inlet 11*a* to receive refrigerant from the inlet 11*a*, with the first portion D1 having at least one first refrigerant liquid distribution opening 68 and a first refrigerant vapor distribution outlet opening O. Optionally, the shroud 26 may also be considered part of the first portion D1 of the distributor 20. The second tray part 23 along with a bottom of the first tray part 22 form parts a second portion D2 of the distributor 20. The first portion D1 of the distributor 20 performs gas/liquid refrigerant separation/distribution as a first stage of gas /liquid separation/distribution carried out by the distributor 20. The second portion D2 of the distributor 20 performs gas/liquid refrigerant separation/distribution as a second stage of gas/liquid separation/distribution carried out by the distributor 20. The third tray part 27 can be considered a third portion of the refrigerant distributor 20, which serves to merely equally distribute liquid refrigerant (does not perform gas/liquid separation) received from the second portion D2 of the refrigerant distributor 20 over the entire tube bundle 30.

The first portion D1 of the refrigerant distributor 20 includes a first inner distributor casing (formed by the inlet channel part 21 and the channel section 60) and a first outer distributor casing (formed by the first tray part 22, the first canopy member 24 and optionally the shroud 26). The first inner distributor casing is disposed within the first outer distributor casing. The first inner distributor casing is connected to the refrigerant inlet 11*a*, and the first inner distributor casing includes at least one first inner distribution opening 46 to distribute refrigerant into an interior space of the first outer distributor casing. The first outer distributor casing has the at least one liquid refrigerant distribution opening 68 and the refrigerant vapor distribution outlet opening O. Therefore, the first outer distributor casing includes the first tray part 22 extending longitudinally below the first inner distributor casing (formed by the inlet channel part 21 and the channel section 60), and the first canopy part 24 extending longitudinally above the first inner distributor casing. The first tray part 22 and the first canopy part 24 are connected to each other on lateral sides of the first portion D1 of the refrigerant distributor 24. The at least one first liquid refrigerant distribution opening 68 is formed at a location below a vertical location of the first refrigerant vapor distribution outlet opening O.

Therefore, the distributor 20 is connected to the refrigerant inlet 11*a* and includes the first portion D1 (the inlet channel part 21 being part of the first portion) connected to the refrigerant inlet 11*a* to receive refrigerant from the inlet 11, the first portion D1 having at least one first refrigerant liquid distribution opening 68 and a first refrigerant vapor distribution outlet opening O. In addition, the distributor 20 includes the second portion D2 (the second tray part 23) connected to the first portion D1 (the first tray part 22, which forms part of the first and second portions D1 and D2) to receive refrigerant from the at least one first refrigerant liquid distribution opening 68, the second portion D2 having at least one second refrigerant liquid distribution opening 108 and at least one second refrigerant vapor distribution outlet opening (92*a* and 94*a*). Even though a plurality of openings 92*a* and a plurality of openings 94*a* are included in the illustrated embodiment, it will be apparent to those skilled in the art from this disclosure that fewer openings are possible. In any case, the second portion D2 of the distributor 20 includes at least one second refrigerant vapor distribution outlet opening. In addition, even though a pair of channels CH1 and CH2 are shown, it will be apparent to those skilled in the art from this disclosure that a single channel could be provided. However, including the recess R and the pair of channels CH1 and CH2, reduces the volume in the second portion (second tray 23) of the refrigerant distributor, which can reduce the amount of refrigerant needed.

In addition, the second portion D2 of the refrigerant distributor 20 includes a pair of side walls 92 and 94 extending downwardly from the first portion D1 of the refrigerant distributor 20 and a lateral wall 90 extending between the side walls 92 and 94 to define at least one second distribution channel CH1 and/or CH2 together with the side walls 92 and 94. The at least one second refrigerant vapor distribution outlet opening 92*a* and 92*b* includes a plurality of second refrigerant vapor distribution outlet openings 92*a* and 94*a* with at least one of the second refrigerant vapor distribution openings 92*a* formed in the side wall 92 and at least one of the second refrigerant vapor distribution openings 94*a* formed in the side wall 94. Even though in the illustrated embodiment a plurality of second refrigerant liquid distribution openings are formed in each lateral wall, it will be apparent to those skilled in the art from this disclosure that fewer openings or even a single opening can be sufficient. In the illustrated embodiment, the second refrigerant vapor distribution outlet openings 92*a* and 94*a* are longitudinally extending slots disposed closer to upper ends of the side walls 92 and 94 than to lower ends of the side walls 92 and 94, respectively.

Referring again to FIGS. 4-9, the heat transferring unit 30 (tube bundle) will now be explained in more detail. The tube bundle 30 is disposed below the refrigerant distributor 20 so that the liquid refrigerant discharged from the refrigerant distributor 20 is supplied onto the tube bundle 30. The tube bundle 30 includes a plurality of heat transfer tubes 31 that extend generally parallel to the longitudinal center axis C of the shell 10 as shown in FIG. 6. The heat transfer tubes 31 are made of materials having high thermal conductivity, such as metal. The heat transfer tubes 31 are preferably provided with interior and exterior grooves to further promote heat exchange between the refrigerant and the water flowing inside the heat transfer tubes 31. Such heat transfer tubes including the interior and exterior grooves are well known in the art. For example, GEWA-B tubes by Wieland Copper Products, LLC may be used as the heat transfer tubes 31 of this embodiment. As best understood from FIGS. 6-7, the heat transfer tubes 31 are supported by a plurality of vertically extending support plates 32, which are fixedly coupled to the shell 10. The support plates 32 also support the third tray part 27, which is fixedly attached to the support plates 32.

In this embodiment, the tube bundle 30 is arranged to form a two-pass system, in which the heat transfer tubes 31 are divided into a supply line group disposed in a lower portion of the tube bundle 30, and a return line group disposed in an upper portion of the tube bundle 30. As shown in FIG. 6, inlet ends of the heat transfer tubes 31 in the supply line group are fluidly connected to the water inlet pipe 15 via the inlet water chamber 13a of the connection head member 13 so that water entering the evaporator 1 is distributed into the heat transfer tubes 31 in the supply line group. Outlet ends of the heat transfer tubes 31 in the supply line group and inlet ends of the heat transfer tubes 31 of the return line tubes are fluidly communicated with a water chamber 14*a* of the return head member 14. Therefore, the water flowing inside the heat transfer tubes 31 in the supply line group is discharged into the water chamber 14*a*, and redistributed into the heat transfer tubes 31 in the return line group.

Outlet ends of the heat transfer tubes 31 in the return line group are fluidly communicated with the water outlet pipe 16 via the outlet water chamber 13*b* of the connection head member 13. Thus, the water flowing inside the heat transfer tubes 31 in the return line group exits the evaporator 1 through the water outlet pipe 16. Although, in this embodiment, the evaporator 1 is arranged to form a two-pass system in which the water goes in and out on the same side of the evaporator 1, it will be apparent to those skilled in the art from this disclosure that the other conventional system such as a one-pass or three-pass system may be used. Moreover, in the two-pass system, the return line group may be disposed below or side-by-side with the supply line group instead of the arrangement illustrated herein.

Referring now to FIGS. 6-14, more detailed discussion of operation and a heat transfer mechanism of the evaporator 1 according to the illustrated embodiment will be explained. As described above, the refrigerant in a two-phase state or at least including liquid refrigerant is supplied through the refrigerant inlet 11*a* to the inlet channel part 21 of the refrigerant distributor 20 via the inlet pipe 11*b*. The flow of refrigerant in the evaporator 1 is schematically illustrated in FIGS. 6-9 with arrows, and the inlet pipe 11*b* is omitted for the sake of brevity. The vapor component of the refrigerant supplied to the refrigerant distributor 20 is separated from the liquid component in the first tray part 22 (a first stage separation). The liquid component of the two-phase refrigerant is accumulated in the first tray part 22 and the gas component flows toward the first the refrigerant vapor distribution outlet O. The liquid refrigerant flows out of the first refrigerant liquid distribution opening 68 and into the second tray 23. This is a first stage of refrigerant gas/liquid separation/distribution.

Then in the second tray part 23, liquid refrigerant is discharged downwardly out of the second first refrigerant liquid distribution opening 108. In addition, in the second tray part 23, any remaining gas refrigerant can be discharged out of the second vapor distribution outlet openings 92*a* and 94*a*. This is a second stage of refrigerant gas/liquid separation/distribution. The exact flow areas through the holes 68 and 108 can be determined based on experimentation. After the liquid refrigerant is distributed to the third tray part 27, the liquid refrigerant received in the third tray part 27 can then be equally distributed to the tube bundle 30. Thus, the heat transferring unit 30 is disposed inside of the shell 10 below the refrigerant distributor 20 to receive liquid refrigerant discharged from the second portion (from the second tray part 23, after passing through the third tray part 27) of refrigerant distributor 20.

As best understood from FIG. 6 refrigerant vapor (gas) cannot flow directly from the first tray part 22 to the shell refrigerant vapor outlet 12*a*. Rather, the gas (or vapor) refrigerant must flow back towards the refrigerant inlet 11*a* (to the left), through the refrigerant vapor distribution outlet O, and then flow toward the shell refrigerant vapor outlet 12*a*. Alternatively, vapor can flow from the second vapor distribution outlet openings 92*a* and 94*a* or from the tube bundle 30 itself toward the shell refrigerant vapor outlet 12*a*. However, flow from these points would occur after two stages of refrigerant gas/liquid separation/distribution.

Referring again to FIG. 6, in the illustrated embodiment, both inlet side plates 42 and 44 have holes 46 formed continuously along their entire heights but only along a predetermined length $L_{perf}$ shorter than a length $L_{dis}$ of the distributor 20 In addition, the predetermined length $L_{perf}$ is preferably shorter than the length of the first canopy part 24. The divider plates 33 have lengths approximately equal to the predetermined length $L_{perf}$. However, it will be apparent to those skilled in the art from this disclosure that different patterns of holes can be used, or even a metal mesh material or any suitable perforated material can be used instead of the plate material with holes. Moreover, is will be apparent that the predetermined length $L_{perf}$ can be determined depending on the pattern of holes 46 and/or the amount of flow therethrough, e.g., if the inlet lateral side plates 42 and 44 are perforated material or mesh material instead of plates with holes 46 formed therein the predetermined length $L_{perf}$ could be shorter than as illustrated herein. For example, holes 46 can be provided only above a predetermined height, or continuous flanges can be provided in the first tray part 22 so that liquid refrigerant only exits the inlet channel part 21 above a certain level. In the illustrated embodiment, the length $L_{dis}$ of the distributor 20 minus the predetermined length $L_{perf}$ equals a solid length $L_{sol}$. The smaller number of outer holes 68 of the first tray part 22 are formed along the length $L_{sol}$ as seen in FIG. 4 at the end of the distributor 20 remote from the refrigerant inlet 11*a*. Thus, the second portion D2 of the refrigerant distributor 20 includes at least one divider plate 33 arranged to divide the second portion D2 into at least two duct sections (e.g., two pairs in the illustrated embodiment), the second refrigerant liquid distribution openings 108 are located on a first side of the at least one divider plate 33 to receive refrigerant from one of the duct sections, and the first refrigerant liquid distribution openings 68 are located to distribute refrigerant into both of the duct sections of the second portion D2. In the illustrated embodiment, the inlet top plate 40 is rigidly attached to the refrigerant inlet 11*a*, and the inlet channel part 21 is fixed to the first tray part 22. The first canopy part 24 is attached to the first tray part 22 to overlie the areas with holes 46 of the inlet lateral side plates 42 and 44, as explained in more detail below.

As shown in FIG. 7, the tube bundle 30 of the illustrated embodiment is hybrid tube bundle including a falling film region and a flooded region. The heat transfer tubes 31 in the falling film region are configured and arranged to perform falling film evaporation of the liquid refrigerant. The columns of the heat transfer tubes 31 are preferably disposed with respect to the third discharge openings 28 of the third tray part 27 so that the liquid refrigerant discharged from the third discharge openings 28 is deposited onto an uppermost one of the heat transfer tubes 31 in each of the columns.

The liquid refrigerant that did not evaporate in the falling film region continues falling downwardly by force of gravity into the flooded region. While a hybrid tube bundle is disclosed in the illustrated embodiment, it will be apparent to those skilled in the art from this disclosure that other tube bundle designs can be used together with the distributor 20 in the evaporator 1 of the present invention.

In this embodiment, a fluid conduit 8 is fluidly connected to the flooded region within the shell 10. Specifically, the shell 10 includes a bottom outlet pipe 17 in fluid communication with the conduit 8. A pump device (not shown) may be connected to the fluid conduit 8 to return the fluid from the bottom of the shell 10 to the compressor 2 or may be branched to the inlet pipe 11*b* to be supplied back to the refrigerant distributor 20. The pump can be selectively operated when the liquid accumulated in the flooded region reaches a prescribed level to discharge the liquid therefrom to outside of the evaporator 1. It will be apparent to those skilled in the art from this disclosure that instead of the fluid conduit 8, a fluid conduit 8' can be coupled to the flooded region at a location spaced from the bottom most point of the flooded region. Moreover, it will be apparent to those skilled in the art from this disclosure that the pump device (not shown) could instead be an ejector (not shown). Pumps and ejectors such as those mentioned above are well known in the art and thus, will not be explained or illustrated in further detail herein.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. As used herein to describe the above embodiments, the following directional terms "upper", "lower", "above", "downward", "vertical", "horizontal", "below" and "transverse" as well as any other similar directional terms refer to those directions of an evaporator when a longitudinal center axis thereof is oriented substantially horizontally as shown in FIGS. 6 and 7. Accordingly, these terms, as utilized to describe the present invention should be interpreted relative to an evaporator as used in the normal operating position. Finally, terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A heat exchanger adapted to be used in a vapor compression system, the heat exchanger comprising:

a shell having a refrigerant inlet that at least refrigerant with liquid refrigerant flows therethrough and a shell refrigerant vapor outlet, with a longitudinal center axis of the shell extending generally parallel to a horizontal plane;

a refrigerant distributor extending longitudinally within the shell, the refrigerant distributor being connected to the refrigerant inlet and including a first portion connected to the refrigerant inlet to receive refrigerant from the inlet, the first portion having at least one first refrigerant liquid distribution opening and a first refrigerant vapor distribution outlet opening, and a second portion connected to the first portion to receive refrigerant from the at least one first refrigerant liquid distribution opening, the second portion having at least one second refrigerant liquid distribution opening and at least one second refrigerant vapor distribution outlet opening, the first refrigerant vapor distribution outlet opening communicating with an interior of the shell so that refrigerant vapor exiting the first refrigerant vapor distribution outlet opening enters the interior of the shell outside of the refrigerant distributor without passing into the second portion of the refrigerant distributor, and the at least one second refrigerant vapor distribution outlet opening communicating with the interior of the shell so that refrigerant vapor exiting the at least one second refrigerant vapor distribution outlet opening enters the interior of the shell outside of the refrigerant distributor; and a heat transferring unit disposed inside of the shell below the refrigerant distributor to receive liquid refrigerant discharged from the second portion of refrigerant distributor supplied to the heat transferring unit.

2. The heat exchanger according to claim 1, wherein the shell refrigerant vapor outlet is separate from the first and second refrigerant vapor distribution outlet openings of the distributor to distribute refrigerant vapor exiting the first and second refrigerant vapor distribution outlet openings into the interior of the shell before the refrigerant vapor flows out of the shell refrigerant vapor outlet.

3. The heat exchanger according to claim 1, wherein the second portion of the refrigerant distributor includes a pair of side walls extending downwardly from the first portion of the refrigerant distributor and a lateral wall extending between the side walls to define at least one second distribution channel together with the side walls.

4. The heat exchanger according to claim 3, wherein the at least one second refrigerant vapor distribution outlet opening includes a plurality of second refrigerant vapor distribution outlet openings with at least one of the second refrigerant vapor distribution openings formed in each of the side walls.

5. The heat exchanger according to claim 4, wherein the at least one second refrigerant liquid distribution opening includes a plurality of second refrigerant liquid distribution openings formed in the lateral wall.

6. The heat exchanger according to claim 4, wherein each of the side walls has a plurality of second refrigerant vapor distribution outlet openings formed therein.

7. The heat exchanger according to claim 6, wherein the second refrigerant vapor distribution outlet openings are longitudinally extending slots disposed closer to upper ends of the side walls than to lower ends of the side walls.

8. The heat exchanger according to claim 3, wherein the lateral wall is divided into a pair of segments by a recess, with each segment including a lateral section and an inner section extending upwardly from the lateral section to divide the at least one second distribution channel into a pair of second distribution channels, the at least one second refrigerant liquid distribution opening includes a plurality of second refrigerant liquid distribution openings, and at least one of the second refrigerant liquid distribution openings is formed in each of the lateral sections of the distribution channels, and the at least one second refrigerant vapor distribution outlet opening includes a plurality of second refrigerant vapor distribution outlet openings, and at least one of the second refrigerant vapor distribution openings is formed in each of the side walls.

9. The heat exchanger according to claim 8, wherein each of the side walls has a plurality of second refrigerant vapor distribution outlet openings formed therein.

10. The heat exchanger according to claim 9, wherein the second refrigerant vapor distribution outlet openings are longitudinally extending slots disposed at upper ends of the side walls.

11. The heat exchanger according to claim 8, wherein the inner sections are inclined relative to a vertical direction.

12. The heat exchanger according to claim 8, wherein upper ends of the inner sections are connected to each other.

13. A heat exchanger adapted to be used in a vapor compression system, the heat exchanger comprising:

a shell having a refrigerant inlet that at least refrigerant with liquid refrigerant flows therethrough and a shell refrigerant vapor outlet, with a longitudinal center axis of the shell extending generally parallel to a horizontal plane;

a refrigerant distributor extending longitudinally within the shell, the refrigerant distributor being connected to the refrigerant inlet and including a first portion connected to the refrigerant inlet to receive refrigerant from the inlet, the first portion having at least one first refrigerant liquid distribution opening and a first refrigerant vapor distribution outlet opening, and a second portion connected to the first portion to receive refrigerant from the at least one first refrigerant liquid distribution opening, the second portion having at least one second refrigerant liquid distribution opening and at least one second refrigerant vapor distribution outlet opening; and a heat transferring unit disposed inside of the shell below the refrigerant distributor to receive liquid refrigerant discharged from the second portion of refrigerant distributor supplied to the heat transferring unit, the second portion of the refrigerant distributor including includes at least one longitudinally extending divider plate arranged to divide the second portion into at least two longitudinally extending duct sections, the at least one second refrigerant liquid distribution opening being located on a first side of the at least one divider plate to distribute liquid receive refrigerant from one of the duct sections, and the at least one first refrigerant liquid distribution opening being located to distribute refrigerant into both of the duct sections of the second portion.

14. The heat exchanger according to claim 1, wherein the refrigerant distributor includes a shroud at least partially overlying the first refrigerant vapor distribution outlet opening.

15. The heat exchanger according to claim 14, wherein the shroud has a top shroud plate and a pair of side shroud plates extending downwardly from the top shroud plate to form a substantially inverted U shaped configuration.

16. The heat exchanger according to claim 1, wherein the first portion of the refrigerant distributor includes a first inner distributor casing and a first outer distributor casing, the first inner distributor casing is disposed within the first outer distributor casing, the first inner distributor casing is connected to the refrigerant inlet, and the first inner distributor casing includes at least one first inner distribution opening to distribute refrigerant into an interior space of the first outer distributor casing, and the first outer distributor casing has the at least one liquid refrigerant distribution opening and the refrigerant vapor distribution outlet opening.

17. The heat exchanger according to claim 16, wherein the first outer distributor casing includes a first tray part extending longitudinally below the first inner distributor casing, and a first canopy part extending longitudinally above the first inner distributor casing, the first tray part and the first canopy part are connected to each other on lateral sides of the first portion of the refrigerant distributor, and the first canopy part has a longitudinal length shorter than a longitudinal length of the first tray part to form the first refrigerant vapor distribution outlet opening.

18. The heat exchanger according to claim 17, wherein the first tray part has the at least one first liquid refrigerant distribution opening formed therein at a location below a vertical location of the first refrigerant vapor distribution outlet opening.

19. The heat exchanger according to claim 13, wherein the at least one second refrigerant liquid distribution opening includes at least one opening located on each side of the divider plate to distribute liquid refrigerant from both of the duct sections.

20. The heat exchanger according to claim 19, wherein an amount of liquid refrigerant distributed from the at least one second refrigerant liquid distribution opening on opposite sides of the divider plate is different.

21. The heat exchanger according to claim 13, wherein the divider plate extends upwardly from a bottom internal surface of the second portion of the refrigerant distributor.

* * * * *